United States Patent [19]
Vinals et al.
[11] 4,210,158
[45] Jul. 1, 1980

[54] 5-ISOPROPYL-3-NONENE-2,8-DIONE AS FLAVORANT AND AS A FLAVOR ENHANCER IN CONJUNCTION WITH SMOKING TOBACCO AND SMOKING TOBACCO ARTICLES

[75] Inventors: Joaquin F. Vinals, Red Bank, N.J.; Jacob Kiwala, Brooklyn, N.Y.; Richard A. Wilson, Westfield; Braja D. Mookherjee, Holmdel, both of N.J.

[73] Assignee: International Flavors & Fragrances Inc., New York, N.Y.

[21] Appl. No.: 973,398

[22] Filed: Dec. 26, 1978

[51] Int. Cl.[2] ..... A24B 3/12
[52] U.S. Cl. ..... 131/10 R; 131/17 R; 131/144; 131/8 R
[58] Field of Search ..... 131/2, 17 R, 17 A, 144, 131/8, 9, 10 R

*Primary Examiner*—V. Millin
*Attorney, Agent, or Firm*—Arthur L. Liberman

[57] ABSTRACT

Described is the use of cis and/or trans isomers of 5-isopropyl-3-nonene-2,8-dione as flavorants or as flavor enhancers in conjunction with smoking tobacco and smoking tobacco articles and mixtures of same and optical isomers of same in smoking tobaccos, smoking tobacco flavors, substitute smoking tobaccos and substitute smoking tobacco flavors in aroma imparting, enhancing or augmenting compositions whereby, prior to smoking, hay-like notes, bready notes and solanone-like notes with burley tobacco-like aromas and cocoa-like nuances are imparted, enhanced or augmented and, on smoking, burley and cocoa-like notes as well as more body and mouthfeel as well as natural tobacco taste and smoke impact are imparted to smoking tobaccos, smoking tobacco flavors and smoking tobacco articles as well as substitute smoking tobaccos, substitute smoking tobacco flavors and substitute smoking tobacco articles.

6 Claims, No Drawings

5-ISOPROPYL-3-NONENE-2,8-DIONE AS FLAVORANT AND AS A FLAVOR ENHANCER IN CONJUNCTION WITH SMOKING TOBACCO AND SMOKING TOBACCO ARTICLES

BACKGROUND OF THE INVENTION

The present invention concerns the use for augmenting or enhancing the aroma or taste of smoking tobacco, smoking tobacco flavors and smoking tobacco articles as well as substitute smoking tobacco, substitute smoking tobacco flavors and substitute smoking tobacco articles of cis and/or trans isomers of 5-isopropyl-3-nonene-2,8-dione as well as optical isomers thereof wherein such cis and trans isomers of 5-isopropyl-3-nonene-2,8-dione have the structures:

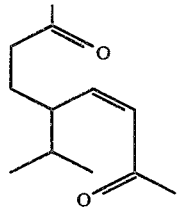

and

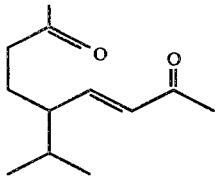

respectively.

There is a continuing search for smoking tobacco flavor compositions which can vary, fortify, modify, enhance, augment or otherwise improve the flavor and/or aroma of smoking tobaccos, substitute smoking tobaccos, smoking tobacco articles, substitute smoking tobacco articles, smoking tobacco flavors and substitute smoking tobacco flavors. A limited amount of such materials that give rise to these properties is available from natural sources but the natural materials obtainable therefrom are subject to wide variations in quality, are expensive and are often in critically short supply. More specifically, there is a considerable need for substituents having solanone-like hay-like and bready notes and burley tobacco-like aromas and cocoa-like nuances prior to smoking and which, on smoking, supply burley and cocoa notes as well as mouthfeel, body and natural tobacco taste and smoke impact to smoking tobaccos, smoking tobacco articles and smoking tobacco flavors as well as to substitute smoking tobaccos, substitute smoking tobacco articles and substitute tobacco flavors.

Shigematsu et al. in Agr. Biol. Chem., Vol. 35, No. 11, pages 1751–1758, 1971 (Title: Studies on Composition of Tobacco Smoke Part XVI, Volatile Compounds from the Neutral Fraction of Tobacco Smoke Condensates (2)) disclose the presence of 5-isopropyl-3-nonene-2,8-dione as a constituent of tobacco smoke. Shigematsu et al, however, do not disclose the organoleptic properties of said 5-isopropyl-3-nonene-2,8-dione or its use as a flavorant and as a flavor enhancer in conjunction with smoking tobacco and smoking tobacco articles.

Johnson and Nicholson in J. Org. Chem. 30, page 2918 (1965) disclose the synthesis of 5-isopropyl-3-nonene-2,8-dione (racemic mixtures of D- and L-isomers of the trans isomer of 5-isopropyl-3-nonene-2,8-dione having the structures:

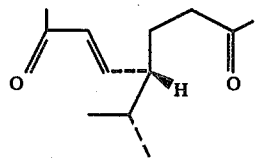

and

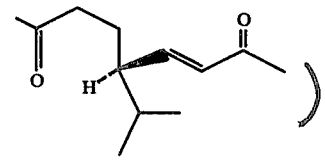

The Johnson and Nicholson syntheses encompass the following reaction schemes:

(I)

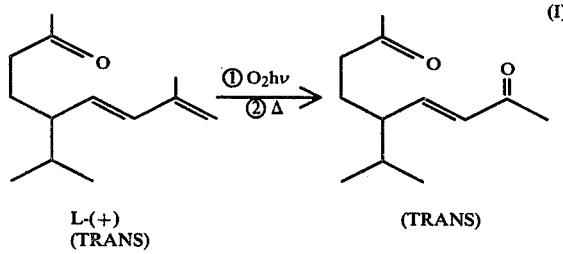

(II)

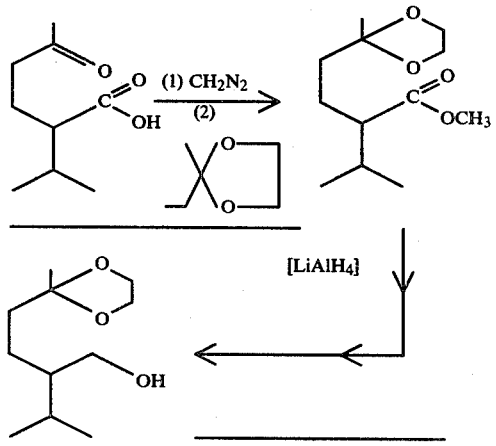

-continued (II)

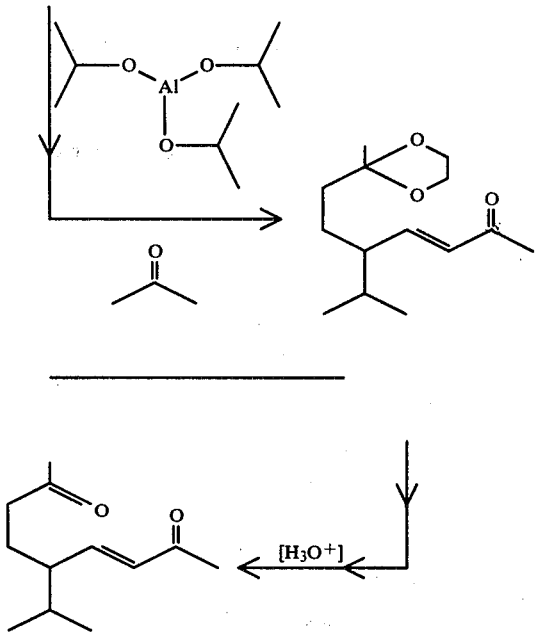

in addition, Demole, U.S. Pat. No. 3,992,458, issued on Nov. 16, 1976 discloses the synthesis of cis and trans isomers of 5-isopropyl-3-nonene-2,8-dione according to the following reaction scheme:

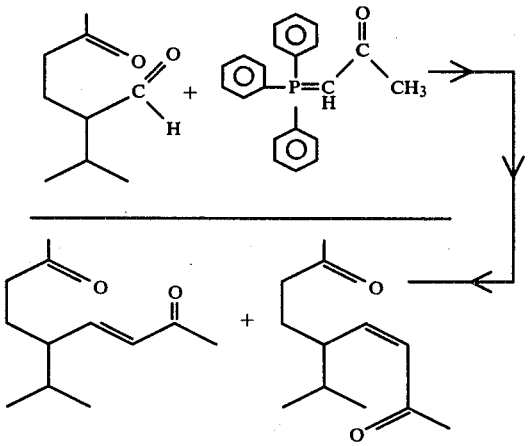

This mixture, however, is indicated to be useful only as a precursor for the production of solanone.

Nothing in the prior art discloses the unexpected, unobvious and advantageous usefulness of cis and/or trans isomers of 5-isopropyl-3-nonene-2,8-dione or stereoisomers thereof as flavorants and as flavor enhancers in conjunction with smoking tobacco and smoking tobacco articles.

THE INVENTION

This invention has to do with the use of cis and/or trans 5-isopropyl-3-nonene-2,8-dione or stereoisomers thereof in augmenting or enhancing the aroma or taste of smoking tobacco, smoking tobacco flavorants, smoking tobacco articles, substitute smoking tobacco, substitute smoking tobacco flavorants and substitute smoking tobacco articles. The structures of the isomeric configurations of the 5-isopropyl-3-nonene-2,8-dione so useful in our invention are:

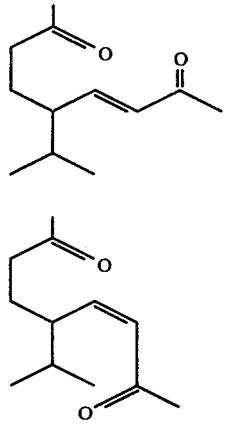

and which represent "trans" and "cis" isomers respectively but which are also intended to encompass both the "D−" and "L−" stereoisomers. Two stereoisomeric configurations exist for each of the cis and trans isomers of 5-isopropyl-3-nonene-2,8-dione. This is because in each cis ortrans isomer there is one asymmetric carbon atom as indicated by the asterisk adjacent to said asymmetric carbon atom in the following structures:

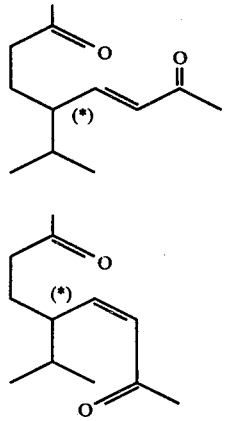

and

Thus, the stereoisomeric configurations of 5-isopropyl-3-nonene-2,8-dione are four in number and are as follows:

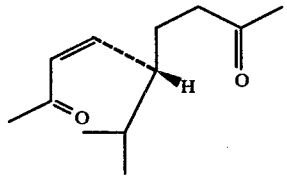

and

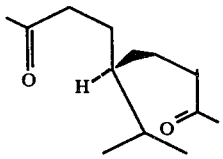

and

-continued

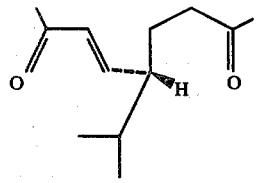

and

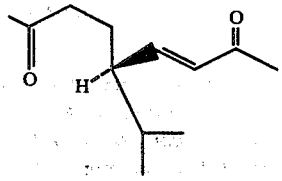

Prior to smoking, the 5-isopropyl-3-nonene-2,8-dione of our invention augments or enhances hay-like, solanone-like and bready notes, burley tobacco-like aromas and cocoa-like nuances; and on smoking the 5-isopropyl-3-nonene-2,8-dione isomers of our invention (taken separately or in combination) supply burley and cocoa notes as well as mouthfeel, body and natural tobacco taste and smoke impact.

Thus, the 5-isopropyl-3-nonene-2,8-dione of our invention and the cis and trans isomers and stereoisomers thereof are capable of supplying and/or potentiating certain tobacco flavor and aroma notes usually lacking in many smoking tobaccos and smoking tobacco flavors heretofore provided.

As used herein the term "enhance" is intended to mean the intensification (without change in kind of quality of aroma or taste) of one or more taste and/or aroma nuances present in the organoleptic impression of smoking tobacco or a smoking tobacco substitute or a smoking tobacco flavor or a smoking tobacco article.

Our invention thus provides an organoleptically improved smoking tobacco product and additives therefor, as well as methods of making same which overcome specific problems heretofore encountered in which specific desired solanone-like, hay-like and bready notes and burley tobacco-like aromas and cocoa-like nuances are created for tobacco prior to smoking and burley and cocoa notes as well as mouthfeel, body, natural tobacco taste and smoke impact are provided on smoking and maintained at the desired uniform level regardless of variations in the tobacco components of the blend.

This invention further provides improved tobacco additives and methods whereby various hay-like, bready, burley tobacco-like and cocoa-like aroma and taste nuances may be imparted to smoking tobacco products prior to smoking and may be readily varied and controlled to produce the desired uniform flavor characteristics.

In carrying out our invention, we add to smoking tobaccos, smoking tobacco articles or smoking tobacco flavor formulations or articles or compositions containing a suitable substitute therefor (e.g., dried lettuce leaves) an aroma and flavor additive containing as an active ingredient a cis and/or trans isomer of 5-isopropyl-3-nonene-2,8-dione or a stereoisomer thereof.

In addition to the cis and/or trans isomers of 5-isopropyl-3-nonene-2,8-dione and stereoisomers thereof, other flavoring and aroma additives may be added to the smoking tobacco materials or substitutes therefor either separately or in admixture with the cis and/or trans isomers of 5-isopropyl-3-nonene-2,8-dione or stereoisomers thereof as follows:

(i) Synthetic Materials:
Beta-ethyl-cinnamaldehyde;
Beta-cyclohomocitral;
Eugenol;
Dipentene;
β-Damascenone;
β-Damascone;
Maltol;
Ethyl Maltol;
Delta-undecalactone;
Delta-decalactone;
Benzaldehyde;
Amyl acetate;
Ethyl butyrate;
Ethyl valerate;
Ethyl acetate;
2-Hexenol-1;
2-Methyl-5-isopropyl-1,3-nonadiene-8-one;
2,6-Dimethyl-2,6-undecadiene-10-one;
2-Methyl-5-isopropyl acetophenone;
2-Hydroxy-2,5,5-8a-tetramethyl-1-(2-hydroxyethyl)-decahydronaphthalene;
Dodecahydro-3a,6,6,9a-tetramethylnaphtho-[2,1,b]-furan;
4-Hydroxy hexanoic acid, gamma lactone; and
Polyisoprenoid hydrocarbons defined in Example V of U.S. Pat. No. 3,589,372 issued on June 29, 1971.

(ii) Natural Oils:
Celery seed Oil;
Coffee extract;
Bergamot Oil;
Cocoa extract;
Nutmeg Oil;
Origanum Oil.

An aroma and flavoring concentrate containing the cis and/or trans isomers of 5-isopropyl-3-nonene-2,8-dione or stereoisomers thereof and, if desired, one or more of the above-defined additional flavoring additives may be added to the smoking tobacco material, to the filter or to the leaf or paper wrapper. The smoking tobacco material may be shredded, cured, cased and blended tobacco material or reconstituted tobacco material or tobacco substitutes (e.g., lettuce leaves) or mixtures thereof. The proportions of flavoring additives may be varied in accordance with taste but insofar as enhancement or the imparting of natural notes, we have found that satisfactory results are obtained if the proportion by weight of the sum total of the cis and/or trans isomers of 5-isopropyl-3-nonene-2,8-dione or stereoisomers thereof is between 100 ppm and 2500 ppm (parts per million) (0.01%–0.25% of the active ingredients to the smoking tobacco material. We have further found that satisfactory results are obtained if the proportion by weight of the sum total of the cis and trans isomers of 5-isopropyl-3-nonene-2,8-dione or stereoisomers thereof used to flavoring material is between 1,000 and 15,000 ppm (0.10%–1.5%).

Any convenient method for incorporating the cis and/or trans isomers of 5-isopropyl-3-nonene-2,8-dione or stereoisomers thereof in the smoking tobacco product may be employed. Thus, the cis and/or trans isomers of 5-isopropyl-3-nonene-2,8-dione or stereoisomers thereof taken alone or along with other flavoring additives may be dissolved in a suitable solvent such as ethanol, pentane, diethyl ether and/or other volatile organic solvents and the resulting solution may either be sprayed on the cured, cased and blended tobacco material or the tobacco material may be dipped into such solution. Under certain circumstances, a solution of the cis and/or trans isomers of 5-isopropyl-3-nonene-2,8-dione or stereoisomers thereof taken alone or further together with other flavoring additives as set forth above, may be applied by means of a suitable applicator such as a brush or roller on the paper or leaf wrapper for the smoking product, or it may be applied to the filter by either spraying, or dipping, or coating.

Further, it will be apparent that only a portion of the tobacco or substitute therefor need be treated and the thus treated tobacco may be blended with other tobaccos before the ultimate tobacco product is formed. In such cases, the tobacco treated may have the cis and/or trans isomers of 5-isopropyl-3-nonene-2,8-dione or stereoisomers thereof in excess of the amounts or concentrations above-indicated so that when blended with other tobaccos, the final product will have the percentage within the indicated range.

In accordance with one specific example of our invention, an aged, cured and shredded domestic burley tobacco is sprayed with a 20% ethyl alcohol solution of the trans isomer of 5-isopropyl-3-nonene-2,8-dione (containing D+ and L+ isomers in a 50:50 ratio) in an amount to provide a tobacco composition containing 2000 ppm by weight of 5-isopropyl-3-nonene-2,8-dione on a dry basis.

Thereafter, the alcohol is removed by evaporation and the tobacco is manufactured into cigarettes by the usual techniques. The cigarette when treated as indicated has a desired and pleasing aroma (increased smoke body sensation in the mouth with enhanced natural tobacco-like notes and pleasant aromatic hay-like, bready, burley tobacco-like and cocoa-like nuances).

While our invention is particularly useful in the manufacture of smoking tobacco, such as cigarette tobacco, cigar tobacco and pipe tobacco, other tobacco products formed from sheeted tobacco dust or fines may also be used. Likewise, the cis and/or trans isomers of 5-isopropyl-3-nonene-2,8-dione or stereoisomers thereof of our invention can be incorporated with materials such as filter tip materials, seam paste, packaging materials and the like which are used along with tobacco to form a product adapted for smoking. Furthermore, the cis and/or trans isomers of 5-isopropyl-3-nonene-2,8-dione or stereoisomers thereof can be added to certain tobacco substitutes of natural or synthetic origin (e.g., dried lettuce leaves) and, accordingly, by the term "tobacco" as used throughout this specification is meant any composition intended for human consumption by smoking whether composed of tobacco plant parts or substitute materials or both.

The following Example I serves to illustrate our invention. All parts and percentages given herein are by weight unless otherwise specified.

EXAMPLE IA

PREPARATION OF TRANS 5-ISOPROPYL-3-NONENE-2,8-DIONE AS A FLAVORANT AND AS A FLAVOR ENHANCER IN CONJUNCTION WITH SMOKING TOBACCO AND SMOKING TOBACCO ARTICLES

REACTION:

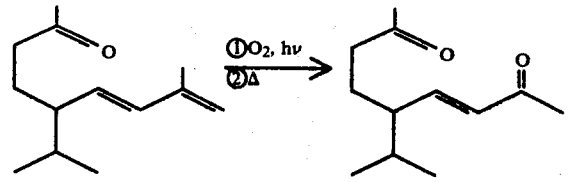

L-(+) (TRANS) (TRANS)

One gram of solanone is placed in an open 50 ml beaker and irradiated for 8 days with a mercury ultraviolet lamp. Aliquots are removed for GLC analysis on a 400'×0.032" glass SE-30 column at 4 hour intervals showing the gradual formation of a single late-eluting peak which levels off after 7 days at about a 50% conversion. This component is isolated by preparative GLC on a 20'×0.125" 5% SE-30 column and analyzed by means of mass spectral, infrared and NMR analysis. All spectral data indicates the structure of Norsolanadione as follows.

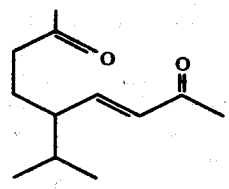

EXAMPLE IB

TOBACCO FORMULATION

A tobacco mixture is prepared by admixing the following ingredients:

| Ingredients | Parts by Weight |
|---|---|
| Bright | 40.1 |
| Burley | 24.9 |
| Maryland | 1.1 |
| Turkish | 11.6 |
| Stem (flue-cured) | 14.2 |
| Glycerine | 2.8 |
| Water | 5.2 |

Cigarettes are prepared from this tobacco.

The following flavor formulation is prepared:

| Ingredients | Parts by Weight |
|---|---|
| Ethyl butyrate | .05 |
| Ethyl valerate | .05 |
| Maltol | 2.00 |
| Cocoa extract | 26.00 |
| Coffee extract | 10.00 |
| Ethyl alcohol | 20.00 |
| Water | 41.90 |

The above-stated tobacco flavor formulation is applied at the rate of 0.1% to all of the cigarettes produced using the above tobacco formulations. Half of the cigarettes are then treated with 500 or 2000 ppm of 5-isopropyl-3-nonene-2,8-dione prepared according to Example IA. The control cigarettes not containing the 5-isopropyl-3-nonene-2,8-dione produced according to Example IA and the experimental cigarettes which contain the 5-isopropyl-3-nonene-2,8-dione produced according to Example IA are evaluated by paired comparison and the results are as follows:

The experimental cigarettes are found to have more body in tobacco smoke flavor and a fuller body sensation with more mouthfeel in addition to excellent burley tobacco-like and cocoa notes. The tobacco-like notes are enhanced and the flavor of the tobacco on smoking is more aromatic with cocoa-like and burley tobacco-like aroma and taste nuances.

The flavor of the experimental cigarettes, prior to smoking, is solanone-like, hay-like and burley tobacco-like. All cigarettes are evaluated for smoke flavor with a 20 mm cellulose acetate filter.

What is claimed is:

1. A process for augmenting or enhancing the aroma or taste of a smoking tobacco comprising the step of adding to said smoking tobacco an aroma or taste augmenting or enhancing quantity of a cis or trans isomer of 5-isopropyl-3-nonene-2,8-dione or stereo isomer thereof having a structure selected from the group consisting of:

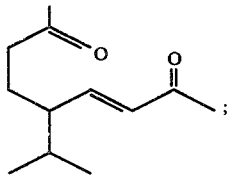

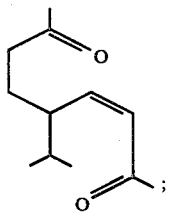

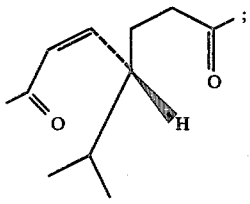

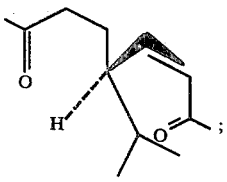

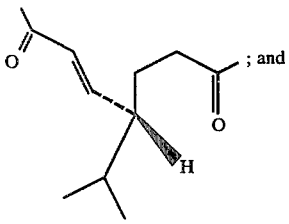

-continued

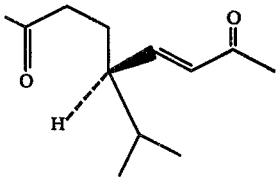

2. The process of claim 1 wherein the structure of the 5-isopropyl-3-nonene-2,8-dione is:

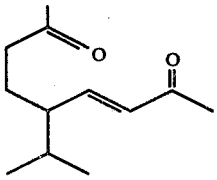

3. A smoking tobacco article comprising smoking tobacco and wrapped around said smoking tobacco a wrapper and in intimate contact with said wrapper and said smoking tobacco a cis or trans isomer of 5-isopropyl-3-nonene-2,8-dione or stereo isomer thereof having the structure selected from the group consisting of:

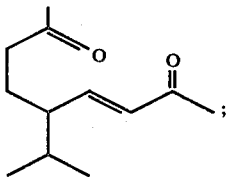

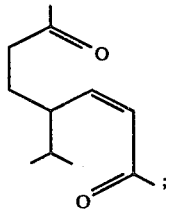

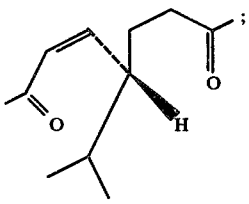

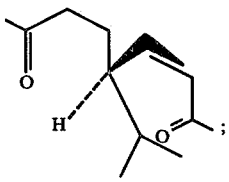

-continued

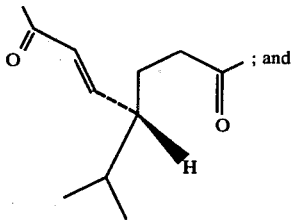

; and

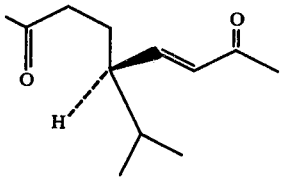

4. The smoking tobacco article of claim 3 wherein the 5-isopropyl-3-nonene-2,8-dione has the structure:

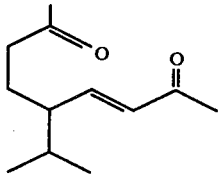

5. A smoking tobacco article comprising a filter tip which comprises filter tip material, a wrapper and smoking tobacco, said wrapper surrounding said smoking tobacco and said filter tip material immediately adjacent to said smoking tobacco and in intimate contact with said filter tip material a cis or trans isomer of 5-isopropyl-3-nonene-2,8-dione or stereo isomer thereof having a structure selected from the group consisting of:

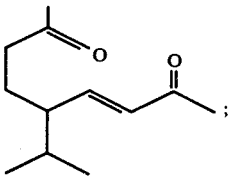

;

-continued

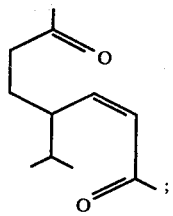

;

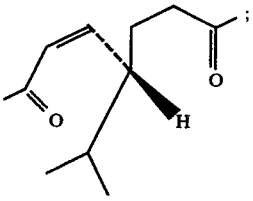

;

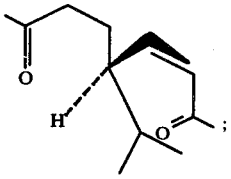

;

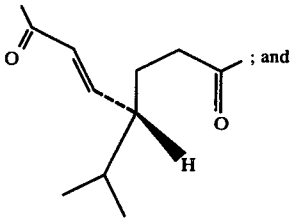

; and

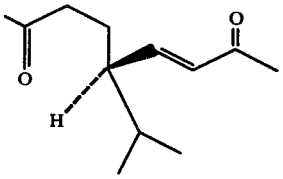

6. The smoking tobacco article of claim 5 wherein the 5-isopropyl-3-nonene-2,8-dione has the structure:

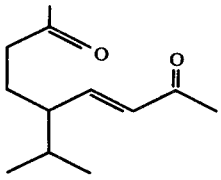

* * * * *